US008999078B2

(12) United States Patent
Yamada et al.

(10) Patent No.: US 8,999,078 B2
(45) Date of Patent: Apr. 7, 2015

(54) FORGING HEAT RESISTANT STEEL, MANUFACTURING METHOD THEREOF, FORGED PARTS AND MANUFACTURING METHOD THEREOF

(75) Inventors: Masayuki Yamada, Yokohama (JP); Reki Takaku, Yokohama (JP); Haruki Ohnishi, Yokohama (JP); Kenichi Okuno, Yokohama (JP); Kenichi Imai, Yokohama (JP); Kazuhiro Miki, Muroran (JP); Tsukasa Azuma, Muroran (JP); Satoru Ohsaki, Muroran (JP)

(73) Assignees: Kabushiki Kaisha Toshiba, Tokyo (JP); The Japan Steel Works, Ltd., Tokyo (JP)

( * ) Notice: Subject to any disclaimer, the term of this patent is extended or adjusted under 35 U.S.C. 154(b) by 0 days.

(21) Appl. No.: 13/336,437

(22) Filed: Dec. 23, 2011

(65) Prior Publication Data

US 2012/0160373 A1 Jun. 28, 2012

(30) Foreign Application Priority Data

Dec. 28, 2010 (JP) ..... P2010-293314

(51) Int. Cl.

| | |
|---|---|
| ***C21D 8/02*** | (2006.01) |
| ***C22C 38/54*** | (2006.01) |
| ***C22C 38/52*** | (2006.01) |
| ***C22C 38/48*** | (2006.01) |
| ***C22C 38/44*** | (2006.01) |
| ***C21D 1/25*** | (2006.01) |
| ***C21D 6/02*** | (2006.01) |

(Continued)

(52) U.S. Cl.

CPC . *C22C 38/44* (2013.01); *C21D 1/25* (2013.01); *C21D 6/02* (2013.01); *C21D 7/13* (2013.01); *C22C 38/46* (2013.01); *C22C 38/48* (2013.01); *C22C 38/52* (2013.01); *C22C 38/54* (2013.01); *C21D 2211/004* (2013.01); *C21D 2211/008* (2013.01)

(58) Field of Classification Search

USPC ..... 148/326, 335, 663, 649, 654; 420/38, 420/64, 106, 107, 109

See application file for complete search history.

(56) References Cited

U.S. PATENT DOCUMENTS

| | | | |
|---|---|---|---|
| 5,560,788 | A | 10/1996 | Yamada et al. |
| 5,817,192 | A | 10/1998 | Kawai et al. |

(Continued)

FOREIGN PATENT DOCUMENTS

| | | | |
|---|---|---|---|
| AT | 408 350 | B | 10/2001 |
| EP | 0 691 416 | A1 | 1/1996 |

(Continued)

OTHER PUBLICATIONS

M. Wisit and M. Hingwe, Tempering of Steel, Heat Treating, vol. 4 ASM Handbook, ASM internation 1991, pp. 121-136.*

(Continued)

*Primary Examiner* — Deborah Yee

(74) *Attorney, Agent, or Firm* — Oblon, McClelland, Maier & Neustadt, L.L.P.

(57) ABSTRACT

A forging heat resistant steel of an embodiment contains in percent by mass C: 0.05-0.2, Si: 0.01-0.1, Mn: 0.01-0.15, Ni: 0.05-1, Cr: 8 or more and less than 10, Mo: 0.05-1, V: 0.05-0.3, Co: 1-5, W: 1-2.2, N: 0.01 or more and less than 0.015, Nb: 0.01-0.15, B: 0.003-0.03, and a remainder comprising Fe and unavoidable impurities.

12 Claims, 4 Drawing Sheets

(51) Int. Cl.
*C21D 7/13* (2006.01)
*C22C 38/46* (2006.01)

(56) References Cited

U.S. PATENT DOCUMENTS

| | | | | |
|---|---|---|---|---|
| 5,972,287 | A * | 10/1999 | Fujita et al. | 420/38 |
| 5,997,806 | A | 12/1999 | Fujita et al. | |
| 7,820,098 | B2 | 10/2010 | Morinaga et al. | |
| 2005/0022529 | A1 | 2/2005 | Takahashi et al. | |

FOREIGN PATENT DOCUMENTS

| | | | |
|---|---|---|---|
| EP | 0 770 696 | A1 | 5/1997 |
| EP | 1 347 073 | A1 | 9/2003 |
| JP | 8-3697 | | 1/1996 |
| JP | 11-131190 | | 5/1999 |
| JP | 2002-256396 | | 9/2002 |
| JP | 2004-359969 | | 12/2004 |
| JP | 2005-060826 | | 3/2005 |
| KR | B1 10-0357306 | | 10/2002 |
| WO | WO 96/32517 | | 10/1996 |

OTHER PUBLICATIONS

Machine-English translation of Japanese patent 11-131190, Kadoya Yoshikuni et al., May 18, 1999.*

"Method for Charpy pendulum impact test of metallic materials", JIS Z 2242, Japanese Industrial Standard, 2005, 23 pages.

"Metallic materials—Uniaxial creep testing in tension—Method of test", JIS Z 2271, Japanese Industrial Standard, 2010, 54 pages.

Extended European Search Report issued Jun. 26, 2012 in patent application No. 11195762.7.

F. Abe, et al., "Alloy design of creep resistant 9Cr steel using a dispersion of nano-sized carbonitrides", International Journal of Pressure Vessels and Piping, vol. 84, No. 1-2, XP005855061, Jan. 20, 2007, pp. 3-12.

Korean Office Action mailed May 7, 2013 in corresponding Korean application No. 2011-138801 with English translation, 8 pp.

Japanese Notice of Reason for Refusal issued Feb. 21, 2014 in connection with corresponding Japanese Patent Application No. 2010-293314, filed Dec. 28, 2010.

F. Abe, "Precipitate design for creep strengthening of 9% Cr tempered martensitic steel for ultra-supercritical power plants.", 17$^{th}$ International Forgemasters Meeting, Santander, Spain Nov. 3-7, 2008.

K. Miki, et al. "Effect of CR on Change of Carbonitrides During Aging in High or Heat Resistant Steels.".

F. Abe, "Precipitate design for creep strengthening of 9% Cr tempered martensitic steel for ultra-supercritical power plants", Mar. 13, 2008.

* cited by examiner

FORGING HEAT RESISTANT STEEL, MANUFACTURING METHOD THEREOF, FORGED PARTS AND MANUFACTURING METHOD THEREOF

CROSS-REFERENCE TO RELATED APPLICATION

This application is based upon and claims the benefit of priority from Japanese Patent Application No. 2010-293314, filed on Dec. 28, 2010; the entire contents of which are incorporated herein by reference.

FIELD

Embodiments described herein relate generally to a forging heat resistant steel, a manufacturing method thereof, forged parts and a manufacturing method thereof.

BACKGROUND

The thermal power system tends to raise the steam temperature of a steam turbine in order to make the generating efficiency much higher. As a result, high temperature characteristics demanded for the forging heat resistant steel to be used for the steam turbine also become much stricter.

There have been proposed many heat resistant steels for forging to be used for steam turbines.

It is necessary to improve a long creep rupture life of a forging heat resistant steel which is used for the steam turbine in order to contribute to further improvement of the generating efficiency. Materials configuring rotating parts and large-size forged parts, such as the turbine rotor of the steam turbine, are required to have excellent creep ductility and toughness from a viewpoint of prevention of breakage at the time of operation.

When the forging heat resistant steel receives prolonged aging and prolonged creep deformation at a high temperature, creep rupture ductility and toughness might be reduced. If degradation of such characteristics occurs in the turbine rotor which is a large rotating structural component, an operational risk increases. A conventional forging heat resistant steel is mainly under study for a compositional improvement from a viewpoint of improving the creep rupture life, but a compositional improvement has not been studied sufficiently considering particularly creep ductility and toughness.

It is very difficult to achieve both improvement of a prolonged creep rupture life and improvement of creep rupture ductility and toughness.

DETAILED DESCRIPTION

Figure 1:
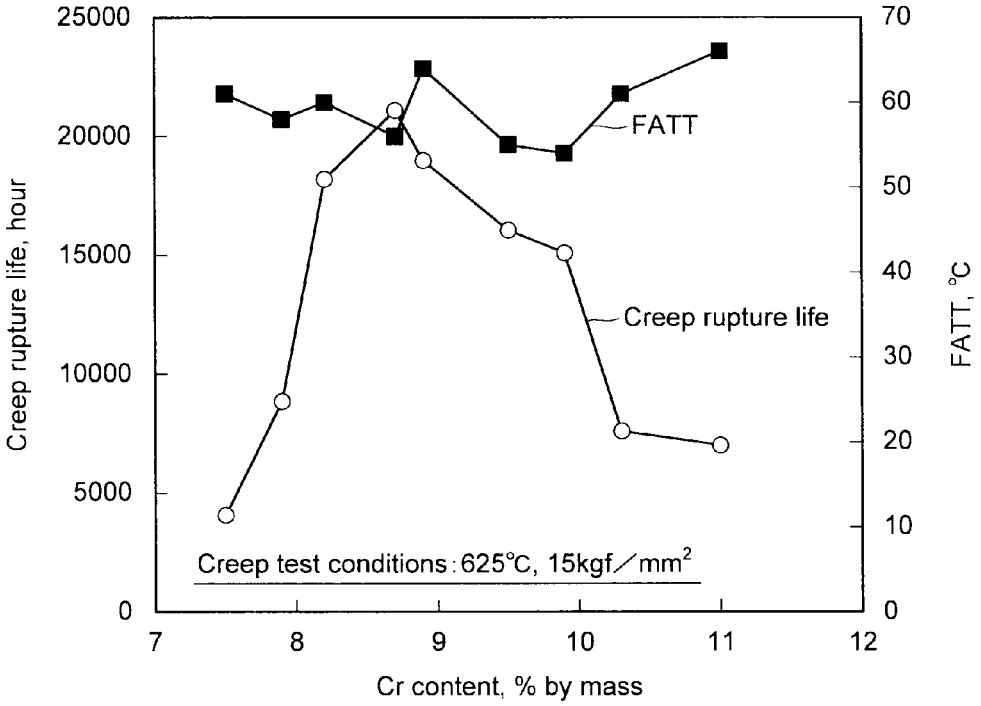
FIG. 1 is a diagram showing a relationship of a Cr content with a creep rupture life and FATT.

According to an embodiment of the invention, the inventors have made a devoted study to improve (a) a prolonged creep rupture life and (b) a creep rupture ductility and toughness of the forging heat resistant steel which is used for the forged parts of a steam turbine or a gas turbine so as to make it possible to provide the generating efficiency of the thermal power system with high efficiency and to improve a long durability of the steam turbine or the gas turbine, and they found that the following means are effective to improve the above characteristics.

(i) To improve the long creep rupture life, it is tried to optimize a Cr content, to make distributed precipitation of fine Nb(C, N) carbonitride, to increase a B (effective B) content which does not form coarse BN, and to make solid-solution strengthening by W.

(ii) To improve creep rupture ductility and toughness, it is tried to optimize the N content from a viewpoint of suppressing the generation of coarse BN after securing the N content which is effective to improve the creep rupture life by distributed precipitation of fine Nb(C, N) carbonitride.

The fine Nb(C, N) carbonitride is Nb(C, N) carbonitride having a diameter of 50 nm or less.

As described above, the inventors have obtained a knowledge that the above-described (a) and (b) characteristics can be improved at the same time by optimizing especially the N content, the B content, the Cr content, and the W content.

The forging heat resistant steel according to an embodiment of the invention contains in percent by mass C: 0.05-0.2, Si: 0.01-0.1, Mn: 0.01-0.15, Ni: 0.05-1, Cr: 8 or more and less than 10, Mo: 0.05-1, V: 0.05-0.3, Co: 1-5, W: 1-2.2, N: 0.01 or more and less than 0.015, Nb: 0.01-0.15, B: 0.003-0.03, and a remainder comprising Fe and unavoidable impurities.

The reason for limitation of each range of component elements of the above-described forging heat resistant steel of the embodiment is described below. In the following description, % used when the component elements are indicated denotes percent by mass unless otherwise specified.

(1) C (Carbon)

C secures hardenability and promotes martensitic transformation. In addition, it forms an $M_{23}C_6$ type carbide with Fe, Cr, Mo, etc. contained in an alloy or forms an MX type carbonitride with Nb, V, N, etc. and enhances a high temperature creep strength by precipitation strengthening. Therefore, C is an indispensable element. C is an element which contributes to improvement of proof stress and is indispensable for suppressing the generation of δ ferrite. To exert the above effects, it is necessary to contain C in 0.05% or more. Meanwhile, when the C content exceeds 0.2%, aggregation and coarsening of carbide and carbonitride tend to occur readily, and high temperature creep rupture strength is reduced. Therefore, the C content is determined to be 0.05 to 0.2%. For the same reason, it is preferable that the C content is 0.08 to 0.13%. It is more preferable that the C content is 0.09 to 0.12%.

(2) Si (Silicon)

Si is an element effective as a deoxidizing agent for the molten steel. To exert this effect, it is necessary to contain Si in 0.01% or more. Meanwhile, when the Si content exceeds 0.1%, segregation increases in a steel ingot, and tempering embrittlement susceptibility increases considerably. And, notch toughness is impaired, a change in precipitate shape is promoted when a high temperature is maintained for a long time, and toughness is deteriorated with time. Therefore, the Si content is determined to be 0.01 to 0.1%.

It is general to use a vacuum carbon deoxidizing method or an electroslag remelting method in these days, and it does not necessarily need to carry out deoxidation with Si. The Si content in this case can be limited to 0.05% or less. Therefore, it is preferable that the Si content is 0.01 to 0.05%. It is more preferable that the Si content is 0.03 to 0.05%.

(3) Mn (Manganese)

Mn is an element effective as a deoxidizing agent or a desulfurizing agent at the time of melting and also effective to improve the strength by enhancing hardenability. To exert the above effects, it is necessary to contain Mn in 0.01% or more. Meanwhile, when the Mn content exceeds 0.15%, Mn is bonded with S to form an MnS non-metallic inclusion, so that toughness is reduced, deterioration of toughness with time is promoted, and high-temperature creep rupture strength is reduced. Therefore, the Mn is determined to be 0.01 to 0.15%.

Recently, the S content can be reduced easily thanks to refining technologies such as ladle refining furnace, and it is not necessary to add Mn as a desulfurizing agent. In this case, the Mn content can be suppressed to 0.1% or less. Therefore, it is preferable that the Mn content is determined to be 0.01 to 0.1%. It is more preferable that the Mn content is 0.05 to 0.1%.

(4) Ni (Nickel)

Ni is an austenite stabilizing element and effective to improve toughness. Ni is also effective to improve hardenability, to suppress the generation of δ ferrite, and to improve strength and toughness at room temperature. To exert the above effects, it is necessary to contain Ni in 0.05% or more. Meanwhile, when the Ni content exceeds 1%, aggregation and coarsening of carbide and Laves phase are promoted, high temperature creep rupture strength is reduced, and temper embrittlement is assisted. Therefore, the Ni content is determined to be 0.05 to 1%. For the same reason, it is preferable that the Ni content is 0.1 to 0.5%. It is more preferable that the Ni content is 0.2 to 0.4%.

(5) Cr (Chromium)

Cr is an element which is essential to enhance oxidation resistance and high temperature corrosion resistance and also to enhance high temperature creep rupture strength by precipitation strengthening by $M_{23}C_6$ type carbide and $M_2X$ type carbonitride. It is necessary to contain the Cr content in 8% or more in order to exert the above effects. Meanwhile, a tensile strength at room temperature and short-time creep rupture strength are enhanced as the Cr content increases, but a long time creep rupture strength tends to decrease. It is also considered to be a cause of an inflection phenomenon of a long creep rupture life. And, when the Cr content increases, a substructure (fine structure) of a martensitic structure is changed notably in a long-time region, and there occurs a progress of deterioration of the fine structure, such as production of sub-grains in the substructure, prominent aggregation or coarsening of the precipitate near the grain boundary, or a significant decrease in dislocation density. Such tendencies are enhanced quickly when the Cr content becomes 10% or more. Therefore, the Cr content is determined to be 8% or more and less than 10%. For the same reason, it is preferable that the Cr content is 8% or more and less than 9%. It is more preferable that the Cr content is 8.5% or more and less than 9%.

(6) Mo (Molybdenum)

Mo forms a state of solid-solution in an alloy to reinforce the solid-solution of a matrix and generates fine carbide (carbonitride) or fine Laves phase to improve a high temperature creep rupture strength. Mo is an element which is also effective for suppression of temper embrittlement. The Mo content is required to be 0.05% or more to exert the above effects. Meanwhile, when the Mo content exceeds 1%, δ ferrite is generated, toughness is reduced considerably, and a high temperature creep rupture strength is also reduced. Therefore, the Mo content is determined to be 0.05 to 1%. For the same reason, it is preferable that the Mo content is 0.5 to 1%. It is more preferable that the Mo content is 0.55 to 0.8%.

(7) V (Vanadium)

V is an element effective to improve a high temperature creep rupture strength by forming fine carbide and carbonitride. The V content is required to be 0.05% or more to exert the above effect. Meanwhile, when the V content exceeds 0.3%, excessive precipitation and coarsening of carbide (carbonitride) are caused, and the high temperature creep rupture strength is reduced. Therefore, the V content is determined to be 0.05 to 0.3%. For the same reason, it is preferable that the V content is 0.15 to 0.25%. It is more preferable that the V content is 0.18 to 0.23%.

(8) Co (Cobalt)

Co suppresses toughness from being reduced by suppressing generation of δ ferrite and improves a high temperature tensile strength and a high temperature creep rupture strength by solid-solution strengthening. It is because the addition of Co does not substantially decrease an $Ac_1$ transformation temperature, and the generation of the δ ferrite can be suppressed without decreasing textural stability. To exert the above effects, it is necessary to contain Co in 1% or more. Meanwhile, when the Co content exceeds 5%, the ductility and the high temperature creep rupture strength are reduced, and the production cost increases. Therefore, the Co content is determined to be 1 to 5%. For the same reason, it is preferable that the Co content is 2 to 4%. It is more preferable that the Co content is 2.5 to 3.5%.

(9) W (Tungsten)

W suppresses aggregation and coarsening of $M_{23}C_6$ type carbide. And, W is an element which is effective to reinforce a solid-solution in a matrix by forming in a state of solid-solution in an alloy, to cause distributed precipitation of the Laves phase on lath boundary or the like and to improve a high temperature tensile strength and a high temperature creep rupture strength. The above effects are significant when W is added together with Mo. To exert the above effects, it is necessary to contain W in 1% or more. Meanwhile, when the W content exceeds 2.2%, it becomes easy to generate δ ferrite and coarse Laves phase, ductility and toughness are reduced, and the high temperature creep rupture strength is also reduced. Therefore, the W content is determined to be 1 to 2.2%. For the same reason, it is preferable that the W content is 1.5% or more and less than 2%. It is more preferable that the W content is 1.6 to 1.9%.

(10) N (nitrogen)

N is bonded with C, Nb, and V to form carbonitride and improves a high temperature creep rupture strength. When the N content is less than 0.01%, a sufficient tensile strength and a high temperature creep rupture strength cannot be obtained. Meanwhile, when the N content is 0.015% or more, its bonding with B is strong, and nitride of BN is generated. Thus, it becomes difficult to produce a sound steel ingot, hot workability is deteriorated, and ductility and toughness are reduced. And, the content of the solid-solution B effective for a high temperature creep rupture strength decreases due to precipitation of the BN phase, so that the high temperature creep rupture strength is reduced. Therefore, the N content is determined to be 0.01% or more and less than 0.015%. For the same reason, it is preferable that the N content is 0.011 to 0.014%.

According to conventional technology (for example, Domestic Re-publication 96/032517 (PCT International Publication WO96/32517)), the N content is determined to be effective up to a relatively high range. But, according to the research made by the inventors, the appropriate N content, which satisfies both significant improvement of creep rupture ductility and toughness and significant improvement of creep rupture strength, is in a relatively low and narrow range of 0.01% or more and less than 0.015%. The determination of the N content into the above range enables to establish both improvement of the prolonged creep rupture life and improvement of the creep rupture ductility and toughness.

(11) Nb (Niobium)

Nb is effective to improve tensile strength at room temperature and forms fine carbide and carbonitride to improve a high temperature creep rupture strength. And, Nb generates fine NbC to promote provision of finer crystal grains and improves toughness. Part of Nb serves to provide an effect of improving the high temperature creep rupture strength by precipitating the MX type carbonitride, which is in complex with the V carbonitride. To exert the above effects, it is necessary to contain Nb in 0.01% or more. Meanwhile, when the Nb content exceeds 0.15%, coarse carbide and carbonitride are precipitated, and ductility and toughness are reduced. Therefore, the Nb content is determined to be 0.01 to 0.15%. For the same reason, it is preferable that the Nb content is 0.03 to 0.08%. It is more preferable that the Nb content is 0.04 to 0.06%.

(12) B (Boron)

B is added in a very small amount to increase hardenability and to improve toughness. B also has an effect to suppress aggregation and coarsening of carbide, carbonitride and Laves phase in martensitic packet, martensitic block, and martensitic lath of austenite grain boundary and its substructure under a high temperature for a long time. In addition, B is an element effective to improve the high temperature creep rupture strength when it is added together with W and Nb. To exert the above effects, it is necessary to contain B in 0.003% or more. Meanwhile, when the B content exceeds 0.03%, B is bonded with N to precipitate a BN phase, hot workability is deteriorated, and high temperature creep rupture ductility and toughness are reduced considerably. And, the content of the solid-solution B effective for the high temperature creep rupture strength decreases due to precipitation of the BN phase, so that the high temperature creep rupture strength is reduced. Therefore, the B content is determined to be 0.003 to 0.03%. For the same reason, it is preferable that the B content is 0.005 to 0.017%. It is more preferable that the B content is 0.007 to 0.015%.

The forging heat resistant steel having the above-described ranges of component elements is suitable as a material configuring, for example, forged parts for steam turbines and gas turbines. As the forged parts for the steam turbines and the gas turbines, there are, for example, a turbine rotor, a turbine disk and the like.

All portions or some portions of the above-described forged parts for the steam turbines and the gas turbines may be configured of the above-described forging heat resistant steel.

The forging heat resistant steel having the above-described ranges of component elements is excellent in long creep rupture life, and also excellent in creep rupture ductility and toughness. In addition, this forging heat resistant steel is excellent in resistance to steam oxidation. Therefore, the above forging heat resistant steel can be used to configure the forged parts such as a turbine rotor and a turbine disk of the steam turbine and the gas turbine so as to provide the forged parts having high reliability in a high temperature environment.

The forging heat resistant steel of the embodiment and a manufacturing method of the forged part manufactured by using this forging heat resistant steel are described below.

For example, the forging heat resistant steel of the embodiment is manufactured as follows.

Raw materials required to obtain component elements, which configure the above-described forging heat resistant steel, are melted in a melting furnace such as an arc type electric furnace or a vacuum induction furnace to make refining and degassing. Subsequently, the molten metal is poured into a mold having a predetermined size and solidified over time to produce a steel ingot. The solidified steel ingot is heated to 1100 to 1200° C., undergone a forging process, and then undergone a quality heat treatment process (quenching treatment and tempering treatment). The forging heat resistant steel is manufactured through the above steps.

For example, the forged parts such as a turbine rotor and a turbine disk of the steam turbine and the gas turbine are manufactured as follows.

Raw materials required to obtain component elements, which configure the above-described forging heat resistant steel, to configure a forged part are melted in a melting furnace such as an arc type electric furnace or a vacuum induction furnace to make refining and degassing. Subsequently, the molten metal is poured into a mold having a predetermined size and solidified over time to produce a steel ingot. When the molten metal is poured in a vacuum environment, gas components in the steel ingot are reduced furthermore because vacuum degassing is carried out, and non-metallic inclusion is also reduced.

The solidified steel ingot is heated to 1100° C. to 1200° C. and undergone a forging process (hot working) by a large press into a forged part shape. After the forging process, a quality heat treatment process (quenching treatment and tempering treatment) is carried out. Thus, forged parts are manufactured through the above steps.

It is preferable here that the heating temperature in the forging process is determined to be in a range of 1100° C. to 1200° C. When the temperature is less than 1100° C., sufficient hot workability of the material cannot be obtained, so that a forging effect at the center part of the forged part is not sufficient or a forging crack is caused during forging deformation. On the other hand, when the temperature exceeds 1200° C., coarsening and ununiformity of crystal grains become significant, deformation by forging becomes ununiform, and the crystal grains are coarsened and made ununiform at the time of the quenching treatment in the quality heat treatment process performed after forging.

The method of manufacturing the forging heat resistant steel or the forged parts is not limited to the above method.

The quality heat treatment process is described below.

(Quenching Treatment)

Most of carbide and carbonitride generated in the material is once put in a state of solid-solution into a matrix by heating for quenching, and the carbide and carbonitride are then precipitated uniformly in a fine state into the matrix by the subsequent tempering treatment. Thus, high temperature creep rupture strength, creep rupture ductility and toughness can be improved.

It is preferable that the quenching temperature is determined to be in a temperature range of 1040 to 1120° C. When the quenching temperature is less than 1040° C., formation of a solid-solution of relatively coarse carbide and carbonitride, which have precipitated before the forging process, into the matrix is not sufficient, and even after the subsequent tempering treatment, they remain as coarse non-solid solution carbide and non-solid solution carbonitride. Therefore, it is difficult to obtain good high temperature creep rupture strength, ductility and toughness. Meanwhile, when the quenching temperature exceeds 1120° C., a δ ferrite phase generates in an austenite phase, and the crystal grains are coarsened, and ductility and toughness are reduced.

In the quenching treatment, the forging material is preferably cooled at a cooling rate of 50 to 300° C./hour in the center part of the forging material so that the forging material has a quenched martensitic structure after the quenching. As a cooling method to obtain the cooling rate of the above range, for example, oil cooling or the like can be adopted.

For example, when the forging material is a turbine rotor, the center part of the forging material is a center of its central axis and in the axial direction. And, when the forging material is formed of a structure having a predetermined thickness, the center part of the forging material is a center of its thickness. That is, such a portion is a part of the forging material where the cooling rate becomes smallest. Here, the cooling rate in the center part of the forging material is defined, but the above-described cooling rate may be a cooling rate at a portion of the forging material where the cooling rate is smallest. The same is also applied to the tempering treatment.

(Tempering Treatment)

The retained austenitic structure generated by the above-described quenching treatment is decomposed by the tempering treatment to have a tempered martensitic structure, carbide and carbonitride are uniformly distributed and precipitated in a matrix, and a dislocation structure is recovered to an appropriate level. Thus, the required high-temperature creep rupture strength, rupture ductility and toughness can be obtained.

This tempering treatment is preferably carried out two times. A first tempering treatment (first stage tempering treatment) aims to decompose the retained austenitic structure, and it is preferably carried out at a temperature in a range of 540 to 600° C. When the temperature of the first stage tempering treatment is less than 540° C., the retained austenitic structure is not decomposed sufficiently. On the other hand, when the temperature of the first stage tempering treatment exceeds 600° C., carbide and carbonitride tend to precipitate preferentially in the martensitic structure than in the retained austenitic structure, the precipitate is distributed and precipitated non-uniformly, and high temperature creep rupture strength is reduced.

In the first stage tempering treatment, the forging material is preferably cooled at a cooling rate of 20 to 100° C./hour in the center part of the forging material so that a large distortion is not generated at a stress concentration part such as a shape change portion when cooling after the first stage tempering treatment. As a cooling method to obtain the cooling rate of the above range, for example, furnace cooling or air cooling can be adopted.

A second tempering treatment (second stage tempering treatment) aims to obtain the required high temperature creep rupture strength, rupture ductility and toughness by making the entire material have a tempered martensitic structure, and it is preferably carried out at a temperature in a range of 650° C. to 750° C. When the temperature of the second stage tempering treatment is less than 650° C., precipitates such as carbide and carbonitride are not precipitated in a stable state, so that the necessary characteristics cannot be obtained for high temperature creep rupture strength, ductility and toughness. On the other hand, when the temperature of the second stage tempering treatment exceeds 750° C., coarse precipitates of carbide and carbonitride are formed, and the required high temperature creep rupture strength cannot be obtained.

In the second stage tempering treatment, the forging material is preferably cooled at a cooling rate of 20 to 60° C./hour so that the distortion is not generated in a stress concentration part such as shape change portion when cooling after the second stage tempering. As a cooling method to obtain the cooling rate of the above range, for example, furnace cooling or the like can be adopted. Since cooling in the second stage tempering treatment is carried out by furnace cooling or the like at a low cooling rate, a temperature difference between the center part and the outer periphery of the forging material is small in the cooling process. Therefore, for definition of the cooling rate in the second stage tempering treatment, it is not limited to the center part of the forging material, but for example it may be a cooling rate at any position in the forging material, such as the center part or the outer periphery of the forging material.

It is described below that the forging heat resistant steel of the embodiment is excellent in high temperature creep rupture characteristics (high temperature creep rupture life and rupture elongation), toughness (Charpy impact value at room temperature, fracture appearance transition temperature (FATT)), and resistance to steam oxidation.

(Test Sample)

Table 1 shows chemical component elements (a remainder comprising Fe and unavoidable impurities) of various test samples (test sample 1 to test sample 69) used for evaluation of material characteristics. It should be noted that test sample 1 to test sample 53 are examples of the forging heat resistant steel of the embodiment, and test sample 54 to test sample 69 are comparative examples of the forging heat resistant steel which are not in the chemical composition range of the forging heat resistant steel of the embodiment.

Table 1 also shows non-solid solution N contents and solid-solution N contents at the time of quenching heating in addition to a total content of N (total N). The non-solid solution N at the time of quenching heating is contained in a very small amount in the non-solid solution carbonitride which suppresses coarsening of crystal grains, and it is mostly bonded with B to generate BN. This non-solid solution N does not contribute to improvement of the creep rupture strength and reduces creep rupture ductility and toughness. On the other hand, the solid-solution N is not bonded with B at the time of quenching heating but forms a solid-solution in a matrix to contribute to solid-solution strengthening or generates fine Nb(C, N) at the time of tempering to contribute to precipitation strengthening. B is bonded with N to generate BN, but other B finely precipitates as $M_{23}(C, B)_6$ at the time of tempering and forms a solid-solution in a matrix to suppress aggregation and coarsening of carbide, carbonitride and Laves phase under a high temperature for a long time. Therefore, B is an element effective to improve high-temperature creep rupture strength. It should be noted that Table 1 shows B, which does not generate BN, as effective B.

For the solid-solution N content, precipitates and inclusions were dropped as residues into a solution by a method of electrolytic extraction, acid decomposition or the like, the solution was filtered, and the N content in the solution other than the residues was measured as the solid-solution N content by an absorptiometer. The non-solid solution N content was determined by subtracting the solid-solution N content from the total content of N (total N).

The effective B content was determined as follows. First, a test sample was undergone acid decomposition and white fume treatment, B generated by distillation was absorbed, a coloration reagent such as curcumin was added to generate a color, absorbance is measured, and the total B content was calculated. Subsequently, the test sample was undergone the electrolytic extraction, residues were recovered by suction filtration, and the residues were undergone the same procedure as the measurement of the total B content to determine a compound type (BN type) B content. And, the compound type (BN type) B content was subtracted from the total B content to determine the effective B content.

TABLE 1

| | | C | Si | Mn | Ni | Cr | Mo | V | Co | W | Total N | Non-Solid Solution N | Solid-Solution N | Nb | B | % by mass Effective B |
|---|---|---|---|---|---|---|---|---|---|---|---|---|---|---|---|---|
| EXAMPLE | TS1 | 0.1 | 0.04 | 0.07 | 0.23 | 8.8 | 0.63 | 0.22 | 3.1 | 1.8 | 0.011 | 0.005 | 0.006 | 0.04 | 0.005 | 0.001 |
| | TS2 | 0.11 | 0.05 | 0.1 | 0.31 | 8.7 | 0.7 | 0.2 | 2.9 | 1.7 | 0.011 | 0.006 | 0.005 | 0.03 | 0.008 | 0.003 |
| | TS3 | 0.11 | 0.05 | 0.12 | 0.21 | 8.8 | 0.71 | 0.2 | 3.1 | 1.7 | 0.01 | 0.005 | 0.005 | 0.04 | 0.011 | 0.007 |
| | TS4 | 0.12 | 0.05 | 0.09 | 0.24 | 8.6 | 0.58 | 0.21 | 2.8 | 1.8 | 0.01 | 0.005 | 0.006 | 0.04 | 0.013 | 0.009 |
| | TS5 | 0.1 | 0.04 | 0.07 | 0.3 | 8.8 | 0.64 | 0.25 | 2.7 | 1.8 | 0.011 | 0.005 | 0.006 | 0.05 | 0.021 | 0.017 |
| | TS6 | 0.13 | 0.03 | 0.1 | 0.22 | 8.8 | 0.73 | 0.2 | 3 | 1.8 | 0.011 | 0.005 | 0.006 | 0.04 | 0.026 | 0.022 |
| | TS7 | 0.1 | 0.04 | 0.08 | 0.2 | 8.7 | 0.62 | 0.19 | 2.8 | 1.7 | 0.013 | 0.006 | 0.007 | 0.04 | 0.005 | 0.001 |
| | TS8 | 0.1 | 0.05 | 0.07 | 0.25 | 8.8 | 0.72 | 0.21 | 2.7 | 1.8 | 0.013 | 0.006 | 0.007 | 0.03 | 0.007 | 0.002 |
| | TS9 | 0.11 | 0.03 | 0.1 | 0.25 | 8.7 | 0.63 | 0.2 | 2.9 | 1.7 | 0.013 | 0.006 | 0.007 | 0.04 | 0.01 | 0.005 |
| | TS10 | 0.12 | 0.04 | 0.08 | 0.24 | 8.6 | 0.67 | 0.21 | 2.9 | 1.7 | 0.013 | 0.006 | 0.007 | 0.04 | 0.013 | 0.008 |
| | TS11 | 0.11 | 0.05 | 0.13 | 0.32 | 8.8 | 0.72 | 0.23 | 3 | 1.7 | 0.013 | 0.007 | 0.006 | 0.05 | 0.022 | 0.016 |
| | TS12 | 0.1 | 0.05 | 0.12 | 0.26 | 8.8 | 0.71 | 0.2 | 3.1 | 1.8 | 0.012 | 0.006 | 0.006 | 0.04 | 0.027 | 0.022 |
| | TS13 | 0.11 | 0.05 | 0.12 | 0.27 | 9.1 | 0.64 | 0.24 | 2.8 | 1.7 | 0.011 | 0.005 | 0.006 | 0.04 | 0.005 | 0.001 |
| | TS14 | 0.12 | 0.04 | 0.1 | 0.28 | 9.1 | 0.66 | 0.19 | 2.7 | 1.6 | 0.01 | 0.005 | 0.005 | 0.03 | 0.007 | 0.003 |
| | TS15 | 0.11 | 0.03 | 0.1 | 0.25 | 8.9 | 0.63 | 0.2 | 2.9 | 1.7 | 0.011 | 0.006 | 0.005 | 0.04 | 0.01 | 0.005 |
| | TS16 | 0.1 | 0.05 | 0.07 | 0.27 | 9.1 | 0.59 | 0.19 | 2.8 | 1.8 | 0.011 | 0.005 | 0.006 | 0.04 | 0.014 | 0.011 |
| | TS17 | 0.1 | 0.05 | 0.07 | 0.23 | 9 | 0.66 | 0.21 | 2.7 | 1.7 | 0.01 | 0.005 | 0.005 | 0.04 | 0.023 | 0.019 |
| | TS18 | 0.12 | 0.03 | 0.08 | 0.31 | 9 | 0.77 | 0.2 | 2.9 | 1.8 | 0.011 | 0.005 | 0.006 | 0.05 | 0.026 | 0.021 |
| | TS19 | 0.11 | 0.03 | 0.1 | 0.25 | 8.9 | 0.63 | 0.2 | 2.9 | 1.7 | 0.013 | 0.006 | 0.007 | 0.04 | 0.005 | 0.001 |
| | TS20 | 0.11 | 0.03 | 0.1 | 0.25 | 8.9 | 0.63 | 0.2 | 2.9 | 1.7 | 0.013 | 0.006 | 0.007 | 0.04 | 0.008 | 0.002 |
| | TS21 | 0.11 | 0.03 | 0.1 | 0.25 | 8.9 | 0.63 | 0.2 | 2.9 | 1.7 | 0.013 | 0.006 | 0.007 | 0.04 | 0.01 | 0.005 |
| | TS22 | 0.11 | 0.03 | 0.1 | 0.25 | 8.9 | 0.63 | 0.2 | 2.9 | 1.7 | 0.013 | 0.006 | 0.007 | 0.04 | 0.014 | 0.009 |
| | TS23 | 0.11 | 0.03 | 0.1 | 0.25 | 8.9 | 0.63 | 0.2 | 2.9 | 1.7 | 0.013 | 0.006 | 0.007 | 0.04 | 0.02 | 0.015 |
| | TS24 | 0.11 | 0.03 | 0.1 | 0.25 | 8.9 | 0.63 | 0.2 | 2.9 | 1.7 | 0.013 | 0.006 | 0.007 | 0.04 | 0.027 | 0.021 |
| | TS25 | 0.1 | 0.03 | 0.09 | 0.29 | 9.4 | 0.62 | 0.2 | 2.7 | 1.8 | 0.011 | 0.005 | 0.006 | 0.04 | 0.005 | 0.001 |
| | TS26 | 0.1 | 0.04 | 0.1 | 0.23 | 9.4 | 0.67 | 0.2 | 2.8 | 1.8 | 0.01 | 0.005 | 0.005 | 0.04 | 0.008 | 0.004 |
| | TS27 | 0.11 | 0.05 | 0.12 | 0.24 | 9.3 | 0.72 | 0.22 | 2.9 | 1.7 | 0.011 | 0.005 | 0.006 | 0.04 | 0.011 | 0.007 |
| | TS28 | 0.09 | 0.05 | 0.13 | 0.27 | 9.4 | 0.59 | 0.21 | 3 | 1.7 | 0.011 | 0.005 | 0.006 | 0.05 | 0.013 | 0.009 |
| | TS29 | 0.1 | 0.03 | 0.08 | 0.22 | 9.3 | 0.65 | 0.22 | 2.7 | 1.8 | 0.01 | 0.005 | 0.005 | 0.04 | 0.022 | 0.018 |
| | TS30 | 0.11 | 0.05 | 0.08 | 0.28 | 9.5 | 0.7 | 0.21 | 2.7 | 1.7 | 0.011 | 0.006 | 0.005 | 0.03 | 0.028 | 0.023 |
| | TS31 | 0.12 | 0.05 | 0.07 | 0.31 | 9.4 | 0.62 | 0.2 | 2.9 | 1.8 | 0.013 | 0.006 | 0.007 | 0.04 | 0.005 | 0.001 |
| | TS32 | 0.1 | 0.04 | 0.1 | 0.28 | 9.4 | 0.57 | 0.21 | 2.8 | 1.7 | 0.012 | 0.006 | 0.006 | 0.04 | 0.007 | 0.002 |
| | TS33 | 0.11 | 0.03 | 0.1 | 0.25 | 9.5 | 0.63 | 0.2 | 2.9 | 1.7 | 0.013 | 0.006 | 0.007 | 0.04 | 0.01 | 0.005 |
| | TS34 | 0.11 | 0.05 | 0.08 | 0.22 | 9.3 | 0.62 | 0.23 | 3 | 1.8 | 0.013 | 0.006 | 0.007 | 0.05 | 0.013 | 0.008 |
| | TS35 | 0.1 | 0.03 | 0.07 | 0.21 | 9.4 | 0.7 | 0.19 | 2.9 | 1.8 | 0.013 | 0.006 | 0.007 | 0.04 | 0.023 | 0.017 |
| | TS36 | 0.1 | 0.04 | 0.08 | 0.2 | 9.3 | 0.73 | 0.2 | 2.8 | 1.7 | 0.012 | 0.006 | 0.006 | 0.04 | 0.026 | 0.021 |
| | TS37 | 0.09 | 0.05 | 0.1 | 0.27 | 9.7 | 0.58 | 0.22 | 2.8 | 1.8 | 0.011 | 0.005 | 0.006 | 0.05 | 0.005 | 0.001 |
| | TS38 | 0.11 | 0.05 | 0.09 | 0.23 | 9.7 | 0.64 | 0.21 | 2.7 | 1.6 | 0.011 | 0.005 | 0.006 | 0.04 | 0.007 | 0.003 |
| | TS39 | 0.1 | 0.03 | 0.11 | 0.28 | 9.8 | 0.66 | 0.2 | 2.9 | 1.8 | 0.01 | 0.005 | 0.005 | 0.04 | 0.012 | 0.008 |
| | TS40 | 0.12 | 0.04 | 0.12 | 0.3 | 9.8 | 0.62 | 0.23 | 2.9 | 1.8 | 0.011 | 0.005 | 0.006 | 0.03 | 0.015 | 0.011 |
| | TS41 | 0.1 | 0.03 | 0.12 | 0.22 | 9.7 | 0.69 | 0.2 | 2.8 | 1.7 | 0.011 | 0.005 | 0.006 | 0.04 | 0.02 | 0.016 |
| | TS42 | 0.1 | 0.05 | 0.09 | 0.21 | 9.7 | 0.73 | 0.21 | 2.7 | 1.8 | 0.01 | 0.005 | 0.005 | 0.05 | 0.026 | 0.022 |
| | TS43 | 0.1 | 0.05 | 0.09 | 0.26 | 9.7 | 0.71 | 0.2 | 3 | 1.7 | 0.013 | 0.006 | 0.007 | 0.03 | 0.005 | 0.001 |
| | TS44 | 0.1 | 0.05 | 0.1 | 0.27 | 9.8 | 0.57 | 0.2 | 3 | 1.8 | 0.012 | 0.006 | 0.006 | 0.04 | 0.008 | 0.003 |
| | TS45 | 0.11 | 0.03 | 0.1 | 0.25 | 9.9 | 0.63 | 0.2 | 2.9 | 1.7 | 0.013 | 0.006 | 0.007 | 0.04 | 0.01 | 0.005 |
| | TS46 | 0.1 | 0.03 | 0.08 | 0.3 | 9.8 | 0.62 | 0.22 | 2.7 | 1.8 | 0.013 | 0.006 | 0.007 | 0.04 | 0.013 | 0.008 |
| | TS47 | 0.11 | 0.04 | 0.09 | 0.26 | 9.7 | 0.69 | 0.21 | 2.7 | 1.8 | 0.013 | 0.007 | 0.006 | 0.04 | 0.022 | 0.015 |
| | TS48 | 0.1 | 0.03 | 0.1 | 0.25 | 9.7 | 0.66 | 0.22 | 2.7 | 1.7 | 0.012 | 0.006 | 0.006 | 0.04 | 0.027 | 0.021 |
| | TS49 | 0.11 | 0.03 | 0.1 | 0.25 | 8.9 | 0.63 | 0.2 | 2.9 | 1.1 | 0.013 | 0.006 | 0.007 | 0.04 | 0.01 | 0.005 |
| | TS50 | 0.11 | 0.03 | 0.1 | 0.25 | 8.9 | 0.63 | 0.2 | 2.9 | 1.4 | 0.013 | 0.006 | 0.007 | 0.04 | 0.01 | 0.005 |
| | TS51 | 0.11 | 0.03 | 0.1 | 0.25 | 8.9 | 0.63 | 0.2 | 2.9 | 1.9 | 0.013 | 0.006 | 0.007 | 0.04 | 0.01 | 0.005 |
| | TS52 | 0.11 | 0.03 | 0.1 | 0.25 | 8.9 | 0.63 | 0.2 | 2.9 | 2.1 | 0.013 | 0.006 | 0.007 | 0.04 | 0.01 | 0.005 |
| | TS53 | 0.11 | 0.03 | 0.1 | 0.25 | 8.2 | 0.63 | 0.2 | 2.9 | 1.7 | 0.013 | 0.006 | 0.007 | 0.04 | 0.01 | 0.005 |
| COMPARATIVE EXAMPLE | TS54 | 0.11 | 0.03 | 0.1 | 0.25 | 8.9 | 0.63 | 0.2 | 2.9 | 1.7 | 0.013 | 0.006 | 0.007 | 0.04 | 0.001 | 0 |
| | TS55 | 0.11 | 0.03 | 0.1 | 0.25 | 8.9 | 0.63 | 0.2 | 2.9 | 1.7 | 0.013 | 0.006 | 0.007 | 0.04 | 0.002 | 0 |
| | TS56 | 0.11 | 0.03 | 0.1 | 0.25 | 8.9 | 0.63 | 0.2 | 2.9 | 1.7 | 0.013 | 0.006 | 0.007 | 0.04 | 0.035 | 0.017 |
| | TS57 | 0.11 | 0.03 | 0.1 | 0.25 | 8.9 | 0.63 | 0.2 | 2.9 | 1.7 | 0.013 | 0.006 | 0.007 | 0.04 | 0.045 | 0.019 |
| | TS58 | 0.11 | 0.03 | 0.1 | 0.25 | 8.9 | 0.63 | 0.2 | 2.9 | 1.7 | 0.005 | 0.002 | 0.003 | 0.04 | 0.01 | 0.005 |
| | TS59 | 0.11 | 0.03 | 0.1 | 0.25 | 8.9 | 0.63 | 0.2 | 2.9 | 1.7 | 0.008 | 0.0035 | 0.0045 | 0.04 | 0.01 | 0.005 |
| | TS60 | 0.11 | 0.03 | 0.1 | 0.25 | 8.9 | 0.63 | 0.2 | 2.9 | 1.7 | 0.017 | 0.008 | 0.009 | 0.04 | 0.01 | 0.005 |
| | TS61 | 0.11 | 0.03 | 0.1 | 0.25 | 8.9 | 0.63 | 0.2 | 2.9 | 1.7 | 0.02 | 0.009 | 0.011 | 0.04 | 0.01 | 0.005 |
| | TS62 | 0.11 | 0.03 | 0.1 | 0.25 | 8.9 | 0.63 | 0.2 | 2.9 | 1.7 | 0.025 | 0.012 | 0.013 | 0.04 | 0.01 | 0.005 |
| | TS63 | 0.11 | 0.03 | 0.1 | 0.25 | 7.5 | 0.63 | 0.2 | 2.9 | 1.7 | 0.013 | 0.006 | 0.007 | 0.04 | 0.01 | 0.005 |
| | TS64 | 0.11 | 0.03 | 0.1 | 0.25 | 7.9 | 0.63 | 0.2 | 2.9 | 1.7 | 0.013 | 0.006 | 0.007 | 0.04 | 0.01 | 0.005 |
| | TS65 | 0.11 | 0.03 | 0.1 | 0.25 | 10.3 | 0.63 | 0.2 | 2.9 | 1.7 | 0.013 | 0.006 | 0.007 | 0.04 | 0.01 | 0.005 |
| | TS66 | 0.11 | 0.03 | 0.1 | 0.25 | 11 | 0.63 | 0.2 | 2.9 | 1.7 | 0.013 | 0.006 | 0.007 | 0.04 | 0.01 | 0.005 |
| | TS67 | 0.11 | 0.03 | 0.1 | 0.25 | 8.9 | 0.63 | 0.2 | 2.9 | 0.7 | 0.013 | 0.006 | 0.007 | 0.04 | 0.01 | 0.005 |
| | TS68 | 0.11 | 0.03 | 0.1 | 0.25 | 8.9 | 0.63 | 0.2 | 2.9 | 2.4 | 0.013 | 0.006 | 0.007 | 0.04 | 0.01 | 0.005 |
| | TS69 | 0.11 | 0.03 | 0.1 | 0.25 | 8.9 | 0.63 | 0.2 | 2.9 | 2.7 | 0.013 | 0.006 | 0.007 | 0.04 | 0.01 | 0.005 |

*TS = Test Sample

Those test samples were formed as follows. Raw materials configuring the each test sample were melted by a vacuum induction melting furnace (VIM) to make degassing, and the molten metal was poured into a mold. And, 20 kg of a steel ingot was produced.

Subsequently, each solidified steel ingot was heated to 1200° C. and undergone forging process at a working ratio with a forging ratio of 3. Subsequently, a quenching treatment, a first stage tempering treatment and a second stage tempering treatment were carried out.

In the quenching treatment, the steel ingot was held heated at a temperature of 1070° C. for 5 hours and then cooled at a cooling rate of 100° C./hour (cooling rate in the center part of the steel ingot). In the first stage tempering treatment, the steel ingot after the quenching treatment was held heated at a temperature of 570° C. for 20 hours and then cooled at a cooling rate of 50° C./hour (cooling rate in the center part of the steel ingot). In the second stage tempering treatment, the steel ingot after the first stage tempering treatment was held heated at a temperature of 680° C. for 20 hours and then cooled at a cooling rate of 50° C./hour. The cooling rate in the second stage tempering treatment was determined to be a cooling rate in the center part of the steel ingot.

(Creep Rupture Test)

The above-described test sample 1 to test sample 69 were used to carry out the creep rupture test under conditions of 625° C. and 20 kgf/mm$^2$ and those of 625° C. and 15 kgf/mm$^2$. Test pieces were produced from the above individual steel ingots.

The creep rupture test was carried out according to JIS Z 2271 (Method of Creep and Creep Rupture Testing for Metallic Materials). Table 2 shows the results of the creep rupture test on the individual test samples. Table 2 shows the creep rupture life (hour) and creep rupture elongation (%) as the creep rupture test results.

TABLE 2

| | | Creep Rupture Characteristics | | | | Resistance to steam oxidation | Toughness | | Survival rate of Nb(C, N) having a diameter of 50 nm or less after 10000-hour aging at 625° C., % |
|---|---|---|---|---|---|---|---|---|---|
| | | 625° C., 20 kgf/mm$^2$ | | 625° C., 15 kgf/mm$^2$ | | | | | |
| | | Creep rupture life, hour | Creep rupture elongation, % | Creep rupture life, hour | Creep rupture elongation, % | 625° C., 3000 hours, mg/cm$^2$ | Charpy impact value at room temperature kgf-m/cm$^2$ | Fracture appearance transition temperature (FATT), ° C. | |
| EXAMPLE | TS1 | 1504.8 | 21.3 | 11423.5 | 19.7 | 15.7 | 5.1 | 60 | 57 |
| | TS2 | 2712.6 | 20.7 | 12098.7 | 18.7 | 13.6 | 5.4 | 58 | 60 |
| | TS3 | 2452.8 | 21.3 | 15134.2 | 18.3 | 15.1 | 5.3 | 55 | 61 |
| | TS4 | 4052.3 | 19.6 | 20975.8 | 19.5 | 14.6 | 6.6 | 50 | 65 |
| | TS5 | 5163.7 | 18.7 | 23418.9 | 17.3 | 13.7 | 6.9 | 52 | 68 |
| | TS6 | 5310.5 | 15.4 | 22451.7 | 14.9 | 14.4 | 5.7 | 61 | 70 |
| | TS7 | 1497.3 | 21.3 | 13089.4 | 21.3 | 13.1 | 4.9 | 65 | 53 |
| | TS8 | 2352.9 | 22.5 | 18740.3 | 22.7 | 15.1 | 4.6 | 63 | 55 |
| | TS9 | 3349.4 | 20.7 | 21090.6 | 18.3 | 13.9 | 6.7 | 56 | 61 |
| | TS10 | 3984.3 | 21.8 | 24562.7 | 17.9 | 12.7 | 5.8 | 60 | 63 |
| | TS11 | 4768.5 | 18.5 | 30096.3 | 18.3 | 14.7 | 5.2 | 63 | 60 |
| | TS12 | 5127.6 | 15.7 | 32396.7 | 15.7 | 13.8 | 6.1 | 58 | 68 |
| | TS13 | 1367.3 | 22.5 | 9879.8 | 21.5 | 10.7 | 5.5 | 64 | 55 |
| | TS14 | 2349.3 | 21.8 | 12324.3 | 20.7 | 11.4 | 5.8 | 62 | 57 |
| | TS15 | 3346.7 | 20.7 | 14985.6 | 17.9 | 10.6 | 4.9 | 70 | 65 |
| | TS16 | 4025.7 | 21.3 | 21065.3 | 18.7 | 10.4 | 5.6 | 63 | 67 |
| | TS17 | 5237.4 | 18.7 | 23439.5 | 17.3 | 11.3 | 5.2 | 67 | 62 |
| | TS18 | 5231.8 | 15.4 | 23097.4 | 16.3 | 12.4 | 6.5 | 58 | 66 |
| | TS19 | 2034.6 | 25.5 | 11285.5 | 21.5 | 12.2 | 6.1 | 57 | 52 |
| | TS20 | 3237.5 | 23.4 | 18760.5 | 20.3 | 11.8 | 6.3 | 60 | 60 |
| | TS21 | 4197.5 | 22.1 | 19120.5 | 18.7 | 10.7 | 5.8 | 64 | 65 |
| | TS22 | 4568.3 | 21.3 | 26548.6 | 19.3 | 10.9 | 5.2 | 61 | 65 |
| | TS23 | 3720.2 | 19.7 | 18667.7 | 18.3 | 10.5 | 5.5 | 77 | 63 |
| | TS24 | 3576.5 | 17.8 | 14255.6 | 16.3 | 11.4 | 5.8 | 85 | 69 |
| | TS25 | 1789.5 | 20.7 | 10998.6 | 19.7 | 8.6 | 5.3 | 66 | 56 |
| | TS26 | 3245.8 | 21.3 | 12675.5 | 18.9 | 8.3 | 6.7 | 52 | 61 |
| | TS27 | 2734.2 | 20.7 | 14878.4 | 18.3 | 9.5 | 5.8 | 60 | 64 |
| | TS28 | 4310.6 | 19.7 | 18972.9 | 18.5 | 9.3 | 6.1 | 57 | 67 |
| | TS29 | 5432.9 | 21.3 | 22361.6 | 16.7 | 10.1 | 5.7 | 63 | 68 |
| | TS30 | 5643.9 | 16.5 | 24529.8 | 15.7 | 9.7 | 5.5 | 68 | 65 |
| | TS31 | 2098.1 | 20.7 | 12677.7 | 21.5 | 8.9 | 5.7 | 63 | 52 |
| | TS32 | 3228.7 | 21.3 | 19761.3 | 20.7 | 8.7 | 5.9 | 60 | 61 |
| | TS33 | 4236.7 | 22.7 | 16043.8 | 18.5 | 9.5 | 6.3 | 55 | 64 |
| | TS34 | 5091.2 | 19.5 | 28629.5 | 18.5 | 9.3 | 6.2 | 57 | 69 |
| | TS35 | 5789.4 | 19.3 | 32406.5 | 17.9 | 9.1 | 5.7 | 60 | 62 |
| | TS36 | 5729.4 | 14.7 | 33464.7 | 14.9 | 8.8 | 6.6 | 52 | 68 |
| | TS37 | 1894.6 | 20.7 | 13428.7 | 20.7 | 6.9 | 5.8 | 60 | 52 |
| | TS38 | 3248.5 | 20.7 | 13887.6 | 21.3 | 7.3 | 5.7 | 65 | 61 |
| | TS39 | 4091.5 | 19.3 | 17534.4 | 18.7 | 6.8 | 6.3 | 50 | 64 |
| | TS40 | 4563.6 | 21.7 | 21399.3 | 19.5 | 6.5 | 6.2 | 53 | 69 |
| | TS41 | 5785.9 | 19.3 | 22198.7 | 17.5 | 7.4 | 5.7 | 67 | 62 |
| | TS42 | 6324.7 | 15.7 | 24534.6 | 15.9 | 7.2 | 4.9 | 71 | 68 |
| | TS43 | 2438.6 | 23.3 | 11867.6 | 19.7 | 7.1 | 5.4 | 65 | 54 |
| | TS44 | 3489.5 | 21.5 | 16762.7 | 20.3 | 7.5 | 5.4 | 62 | 58 |
| | TS45 | 4673.2 | 18.7 | 15093.6 | 18.7 | 7.2 | 6.7 | 54 | 62 |
| | TS46 | 5456.1 | 19.5 | 26549.5 | 18.3 | 6.9 | 6.2 | 60 | 67 |

TABLE 2-continued

| | | Creep Rupture Characteristics | | | | Resistance to steam | Toughness | | Survival rate of Nb(C, N) having a |
|---|---|---|---|---|---|---|---|---|---|
| | | 625° C., 20 kgf/mm$^2$ | | 625° C., 15 kgf/mm$^2$ | | oxidation | | Fracture | diameter of 50 |
| | | Creep rupture life, hour | Creep rupture elongation, % | Creep rupture life, hour | Creep rupture elongation, % | 625° C., 3000 hours, mg/cm$^2$ | Charpy impact value at room temperature kgf-m/cm$^2$ | appearance transition temperature (FATT), ° C. | nm or less after 10000-hour aging at 625° C., % |
| | TS47 | 6239.3 | 18.5 | 33008.4 | 18.1 | 7.2 | 6.1 | 60 | 66 |
| | TS48 | 6390.4 | 16.3 | 36391.3 | 16.3 | 7.1 | 5.8 | 68 | 69 |
| | TS49 | 2814.5 | 21.3 | 10816.3 | 22.7 | 11.5 | 6 | 50 | 55 |
| | TS50 | 3041.6 | 19.6 | 13425.6 | 21.5 | 10.8 | 6.2 | 48 | 62 |
| | TS51 | 3829.1 | 22.7 | 18320.3 | 19.7 | 12.1 | 6.1 | 60 | 67 |
| | TS52 | 3541.9 | 20.7 | 17821.4 | 20.3 | 12.7 | 4.8 | 71 | 58 |
| | TS53 | 2658.5 | 18.5 | 18232.7 | 21.3 | 15.1 | 5.9 | 60 | 61 |
| Comparative | TS54 | 452.8 | 23.3 | 3136.7 | 21.9 | 11.6 | 5.6 | 66 | 35 |
| Example | TS55 | 789.5 | 20.7 | 4023.8 | 22.3 | 10.9 | 5.9 | 63 | 37 |
| | TS56 | 2477.4 | 8.7 | 11826.6 | 7.9 | 11.7 | 1.5 | 105 | 57 |
| | TS57 | 2082.2 | 7.5 | 8529.6 | 8.5 | 11.3 | 1.7 | 98 | 63 |
| | TS58 | 504.1 | 21.3 | 2876.7 | 21.3 | 10.6 | 6.1 | 62 | 30 |
| | TS59 | 921.7 | 22.3 | 4097.6 | 21.7 | 10.8 | 5.7 | 66 | 34 |
| | TS60 | 2896.4 | 8.5 | 15429.6 | 8.7 | 10.3 | 1.4 | 103 | 56 |
| | TS61 | 3002.3 | 9.7 | 10004.7 | 9.3 | 11.2 | 1.8 | 95 | 65 |
| | TS62 | 897.4 | 9.3 | 2945.6 | 9.5 | 11.5 | 1.5 | 97 | 41 |
| | TS63 | 820.5 | 20.7 | 4056.6 | 21.5 | 26.8 | 6.2 | 61 | 38 |
| | TS64 | 1034.3 | 21.3 | 8875.7 | 21.3 | 21.3 | 6.4 | 58 | 42 |
| | TS65 | 4492.1 | 21.3 | 7621.4 | 20.9 | 7.3 | 5.8 | 61 | 36 |
| | TS66 | 6235.1 | 23.7 | 7018.6 | 21.5 | 4.2 | 5.5 | 66 | 35 |
| | TS67 | 1227.2 | 21.5 | 4621.3 | 21.3 | 11.8 | 6.9 | 52 | 37 |
| | TS68 | 4820.3 | 12.7 | 15814.5 | 11.3 | 12.2 | 2.8 | 89 | 35 |
| | TS69 | 3087.7 | 11.8 | 11032.6 | 10.8 | 10.9 | 1.9 | 101 | 31 |

*TS = Test Sample

It is seen as shown in Table 2 that test sample 1 to test sample 53 have a long creep rupture life with the creep rupture strength improved under creep conditions of 625° C. and 20 kgf/mm$^2$ and those of 625° C. and 15 kgf/mm$^2$ in comparison with test sample 54 and test sample 55 (with B content lower than the chemical composition range of the forging heat resistant steel of the embodiment).

It is seen that test sample 1 to test sample 53 have creep rupture elongation improved under creep conditions of 625° C. and 20 kgf/mm$^2$ and those of 625° C. and 15 kgf/mm$^2$ in comparison with test sample 56 and test sample 57 (with B content larger than the chemical composition range of the forging heat resistant steel of the embodiment).

It is seen that test sample 1 to test sample 53 have a long creep rupture life with the creep rupture strength improved under creep conditions of 625° C. and 20 kgf/mm$^2$ and those of 625° C. and 15 kgf/mm$^2$ in comparison with test sample 58 and test sample 59 (with N content lower than the chemical composition range of the forging heat resistant steel of the embodiment).

It is seen that test sample 1 to test sample 53 have creep rupture elongation improved under creep conditions of 625° C. and 20 kgf/mm$^2$ and those of 625° C. and 15 kgf/mm$^2$ in comparison with test sample 60 and test sample 61 (with N content larger than the chemical composition range of the forging heat resistant steel of the embodiment).

It is seen that test sample 1 to test sample 53 have a long creep rupture life with creep rupture strength improved and also creep rupture elongation improved under creep conditions of 625° C. and 20 kgf/mm$^2$ and those of 625° C. and 15 kgf/mm$^2$ in comparison with test sample 62 (with N content larger than the chemical composition range of the forging heat resistant steel of the embodiment).

It is seen that test sample 1 to test sample 53 have a long creep rupture life with creep rupture strength improved under creep conditions of 625° C. and 20 kgf/mm$^2$ and those of 625° C. and 15 kgf/mm$^2$ in comparison with test sample 63 and test sample 64 (with Cr content lower than the chemical composition range of the forging heat resistant steel of the embodiment).

It is seen that test sample 1 to test sample 53 have a long creep rupture life with creep rupture strength improved under creep conditions of 625° C. and 15 kgf/mm$^2$ in comparison with test sample 65 and test sample 66 (with Cr content larger than the chemical composition range of the forging heat resistant steel of the embodiment).

It is seen that test sample 1 to test sample 53 have a long creep rupture life with creep rupture strength improved under creep conditions of 625° C. and 20 kgf/mm$^2$ and those of 625° C. and 15 kgf/mm$^2$ in comparison with test sample (with W content lower than the chemical composition range of the forging heat resistant steel of the embodiment).

It is seen that test sample 1 to test sample 53 have creep rupture elongation improved under creep conditions of 625° C. and 20 kgf/mm$^2$ and those of 625° C. and 15 kgf/mm$^2$ in comparison with test sample 68 and test sample 69 (with W content larger than the chemical composition range of the forging heat resistant steel of the embodiment).

(Charpy Impact Test)

The above-described test sample 1 to test sample 69 were undergone a Charpy impact test under several types of temperature conditions required to obtain room temperature and fracture appearance transition temperature (FATT). Test pieces were produced form the above-described individual steel ingots.

The Charpy impact test was carried out according to JIS Z 2242 (Charpy impact test method for metallic materials). Table 2 shows the Charpy impact test results of the individual test samples. Table 2 shows Charpy impact values (kgf-m/

$cm^2$) at room temperature and fracture appearance transition temperatures (FATT) (° C.) as the Charpy impact test results.

It is seen as shown in Table 2 that test sample 1 to test sample 53 have a high Charpy impact value at room temperature with fracture appearance transition temperature (FATT) lowered and toughness improved in comparison with test sample 56 and test sample 57 (with B content larger than the chemical composition range of the forging heat resistant steel of the embodiment).

It is seen that test sample 1 to test sample 53 have a high Charpy impact value at room temperature with fracture appearance transition temperature (FATT) lowered and toughness improved in comparison with test sample 60 to test sample 62 (with N content larger than the chemical composition range of the forging heat resistant steel of the embodiment).

It is seen that test sample 1 to test sample 53 have a high Charpy impact value at room temperature with fracture appearance transition temperature (FATT) lowered and toughness improved in comparison with test sample 68 and test sample 69 (with W content larger than the chemical composition range of the forging heat resistant steel of the embodiment).

(Evaluation of Resistance to Steam Oxidation)

The above-described test sample 1 to test sample 69 were undergone an evaluation test for the resistance to steam oxidation. As test pieces, flat plates (length of 15 mm, width of 10 mm, and thickness of 3 mm) were produced from the above-described individual steel ingots.

Test pieces were exposed to a steam environment of 625° C. for 3000 hours, and a steam oxidation increase ($mg/cm^2$) after the exposure was measured. It should be noted that the steam oxidation increase denotes an increase in weight of the test sample by generation of an oxide on the surface of the test sample by the steam oxidation. The weight is increased because of oxygen contained in the oxide. The steam oxidation increase was calculated on the basis of the weight which was obtained by subtracting the weight of the test sample before the steam oxidation test from the total weight of the test sample containing the oxide formed on the surface of the test sample by the steam oxidation. Table 2 shows the results of the steam oxidation increase of the individual test samples.

It is seen as shown in Table 2 that test sample 1 to test sample 53 have a small steam oxidation increase and excellent resistance to steam oxidation in comparison with test sample 63 and test sample 64 (with Cr content smaller than the chemical composition range of the forging heat resistant steel of the embodiment).

(Influence of Cr, W, N, and B)

Here, relationships of the contents of Cr, W, N and B, which play particularly an important role for creep rupture characteristics and toughness, with the creep rupture characteristics and toughness were compiled according to the results of the above-described creep rupture test and Charpy impact test.

The above-described relationships were compiled on the basis of the results of measuring the creep rupture life under creep conditions of 625° C. and 15 $kgf/mm^2$ as the creep rupture characteristics and the measured results of FATT as the toughness.

The influences of the Cr content were compiled on the basis of the measured results of test sample 9, test sample 21, test sample 33, test sample 45, test sample 53, and test sample 63 to test sample 66. FIG. 1 is a diagram showing a relationship of a Cr content with creep rupture life and FATT.

It is seen as shown in FIG. 1 that when the Cr content is in a range of 8% or more and less than 10%, the creep rupture life is long, FATT is low, and both creep rupture strength and toughness are excellent. Even within the above range, when the Cr content is in a range of 8% or more and less than 9%, FATT is low, and particularly the creep rupture life becomes long, and it is seen that the above range is more preferable.

Figure 2:
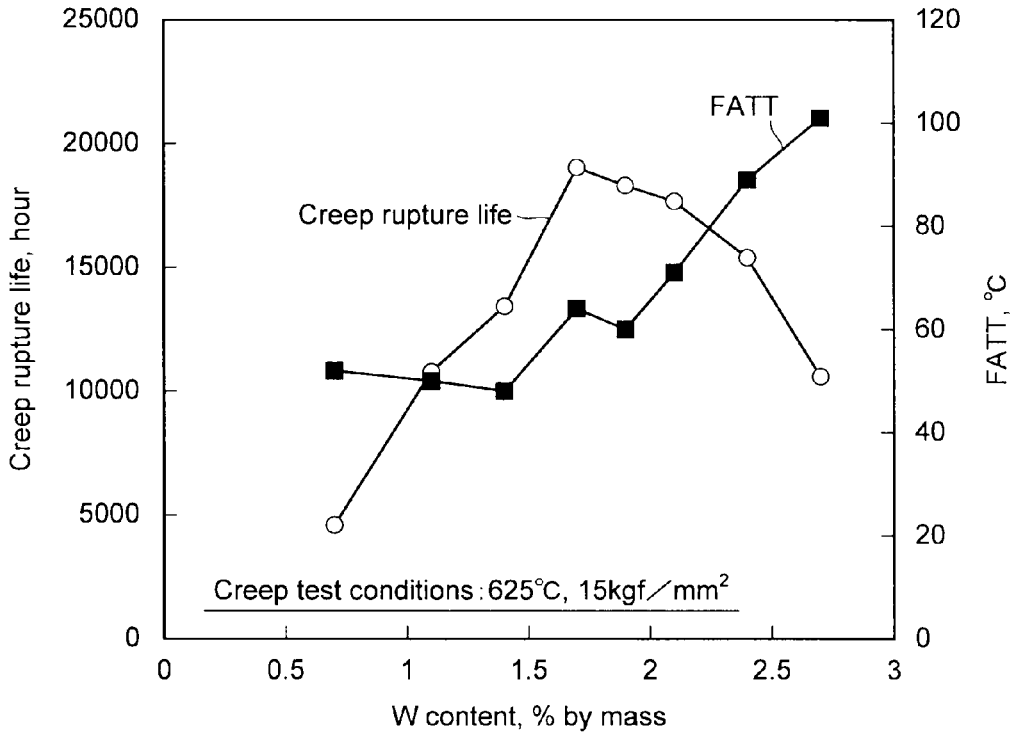
FIG. 2 is a diagram showing a relationship of a W content with a creep rupture life and FATT.

The influences of the W content were compiled on the basis of the measured results of test sample 21, test sample 49, test sample 50, test sample 51, test sample 52, and test sample 67 to test sample 69. FIG. 2 is a diagram showing a relationship of the W content with the creep rupture life and FATT.

It is seen as shown in FIG. 2 that when the W content is in a range of 1 to 2.2%, the creep rupture life is long, FATT is low, and both creep rupture strength and toughness are excellent. When the W content is in a range of 1.5% or more and less than 2% even within the above range, FATT is low, and particularly the creep rupture life becomes long, and it is seen that the above range is more preferable. And, when the W content exceeds 2.2%, FATT increases sharply.

Figure 3:
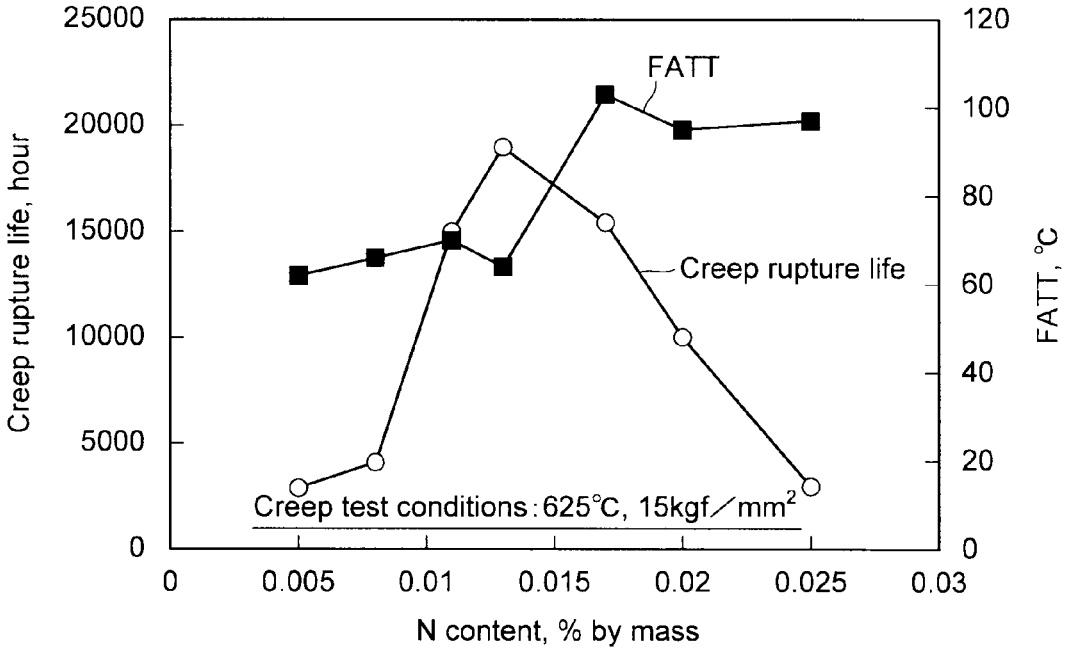
FIG. 3 is a diagram showing a relationship of an N content with a creep rupture life and FATT.

The influences of the N content were compiled on the basis of the measured results of test sample 15, test sample 21, and test sample 58 to test sample 62. FIG. 3 is a diagram showing a relationship of the N content with the creep rupture life and FATT.

It is seen as shown in FIG. 3 that when the N content is in a range of 0.01% or more and less than 0.015%, the creep rupture life is long, FATT is low, and both creep rupture strength and toughness are excellent. Even within the above range, when the N content is in a range of 0.011 to 0.014%, FATT is low, and particularly the creep rupture life becomes long, and it is seen that the above range is more preferable.

Figure 4:
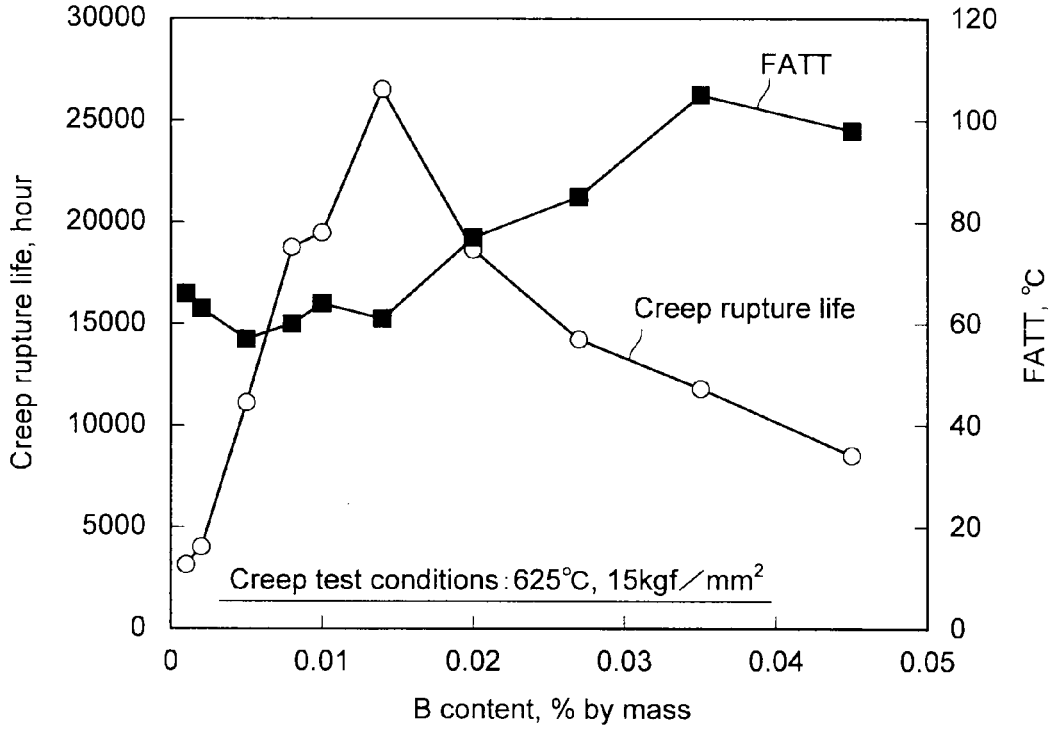
FIG. 4 is a diagram showing a relationship of a B content with a creep rupture life and FATT.

The influences of the B content were compiled on the basis of the measured results of test sample 19 to test sample 24 and test sample 54 to test sample 57. FIG. 4 is a diagram showing a relationship of the B content with the creep rupture life and FATT.

It is seen as shown in FIG. 4 that when the B content is in a range of 0.003 to 0.03%, the creep rupture life is long, FATT is low, and both creep rupture strength and toughness are excellent. Even within the above range, when the B content is in a range of 0.005 to 0.017%, particularly the creep rupture life becomes long, and FATT is low, and it is seen that the above range is more preferable.

(Influences of Quenching Temperature and Tempering Temperature)

Influences of quenching temperature and tempering temperature upon creep rupture characteristics and toughness were examined.

Steel ingots of test sample 21 were undergone quenching treatment and tempering treatment under the following conditions. The quenching treatment was carried out under four conditions including quenching temperatures of 1020° C., 1070° C., 1100° C. and 1150° C., and they were held heated at the individual quenching temperatures for 5 hours. After the five-hour heating, they were cooled at a cooling rate (cooling rate in the center part of the steel ingot) of 100° C./hour.

The first stage tempering treatment was carried out under three conditions of 530° C., 570° C. and 610° C. as the first stage tempering temperature, and heating was held at the each first stage tempering temperature for 20 hours. After the 20-hour heating, cooling was carried out at a cooling rate (cooling rate in the center part of the steel ingot) of 50° C./hour.

The second stage tempering treatment was carried out under four conditions of 630° C., 680° C., 710° C. and 770° C. as the second stage tempering temperature, and heating was held at the each second stage tempering temperature for 20 hours. After the 20-hour heating, cooling was carried out at a cooling rate of 50° C./hour. Here, the cooling rate in the second stage tempering treatment was determined to be a cooling rate in the center of the steel ingot.

Test pieces were produced from the individual steel ingots, and the individual tests were carried out by the same methods as the above-described methods. Evaluation was made on high-temperature creep rupture characteristics (high-temperature creep rupture life and rupture elongation), toughness (Charpy impact value at room temperature), fracture appearance transition temperature (FATT), and resistance to steam oxidation. Table 3 shows the individual test results of high temperature creep rupture characteristics, toughness and resistance to steam oxidation.

TABLE 3

| | | | | Creep rupture characteristics | | | | Resistance | Toughness | |
|---|---|---|---|---|---|---|---|---|---|---|
| | | | | 625° C., 20 kgf/mm$^2$ | | 625° C., 15 kgf/mm$^2$ | | to steam | Charpy | Fracture |
| | Quenching treatment | First stage tempering treatment | Second stage tempering treatment | Creep rupture life, hour | Creep rupture elongation, % | Creep rupture life, hour | Creep rupture elongation, % | oxidation 625° C., 3000 hours, mg/cm$^2$ | impact value at room temperature, kgf-m/cm$^2$ | appearance transition temperature (FATT), ° C. |
| Example (Test Sample 21) | 1020° C., 5 hours (Cooling: 100° C./hour) | 530° C., 20 hours | 630° C., 20 hours | 2899.4 | 18 | 11050.5 | 16.4 | 9.8 | 2.8 | 88 |
| | | | 680° C., 20 hours | 2376.4 | 21.3 | 14345.7 | 17.7 | 10.2 | 4.5 | 86 |
| | | | 710° C., 20 hours | 2768.6 | 22.7 | 15034.2 | 20.7 | 10.5 | 5.2 | 76 |
| | | | 770° C., 20 hours | 1129.6 | 26.6 | 10060.4 | 19.3 | 10 | 4.9 | 59 |
| | | 570° C., 20 hours | 630° C., 20 hours | 2785.2 | 17.7 | 9934.5 | 16.3 | 11.1 | 3.4 | 71 |
| | | | 680° C., 20 hours | 2367.9 | 22 | 13480.7 | 17.7 | 10.5 | 6.2 | 57 |
| | | | 710° C., 20 hours | 1352.7 | 21.7 | 14530.8 | 20.3 | 9.9 | 7.5 | 36 |
| | | | 770° C., 20 hours | 1094.6 | 26.6 | 10076.8 | 19.3 | 10.1 | 8.2 | 38 |
| | | 610° C., 20 hours | 630° C., 20 hours | 1783.7 | 18.1 | 9751.6 | 16.7 | 10 | 3.4 | 69 |
| | | | 680° C., 20 hours | 1163.3 | 22.1 | 8793.7 | 18.3 | 10.3 | 6.8 | 55 |
| | | | 710° C., 20 hours | 895.4 | 21.5 | 7645.3 | 20.7 | 10.8 | 7.1 | 46 |
| | | | 770° C., 20 hours | 324.9 | 27.4 | 4673.9 | 20.7 | 10.2 | 7.3 | 32 |
| | 1070° C., 5 hours (Cooling: 100° C./hour) | 530° C., 20 hours | 630° C., 20 hours | 4521.4 | 17.5 | 14650.8 | 15.3 | 9.9 | 1.9 | 96 |
| | | | 680° C., 20 hours | 4420 | 21.7 | 20549.7 | 18.7 | 10.4 | 4.1 | 79 |
| | | | 710° C., 20 hours | 3893.5 | 21.3 | 21073.6 | 20.7 | 9.8 | 4.4 | 71 |
| | | | 770° C., 20 hours | 1889.7 | 27.4 | 15050.2 | 19.3 | 10.1 | 5.1 | 56 |
| | | 570° C., 20 hours | 630° C., 20 hours | 4894.6 | 18.1 | 14652.8 | 15.7 | 9.9 | 3 | 81 |
| | | | 680° C., 20 hours | 4197.5 | 22.1 | 19120.5 | 18.7 | 10.7 | 5.8 | 64 |
| | | | 710° C., 20 hours | 4016.2 | 22.7 | 22005.1 | 21.3 | 9.7 | 6.2 | 48 |
| | | | 770° C., 20 hours | 1833.8 | 25.3 | 14286.4 | 19.7 | 10.2 | 6.8 | 37 |
| | | 610° C., 20 hours | 630° C., 20 hours | 2785.9 | 17.6 | 14320.6 | 15.3 | 11 | 2.7 | 77 |
| | | | 680° C., 20 hours | 1890.5 | 21.7 | 12287.6 | 17.3 | 9.9 | 5.3 | 61 |
| | | | 710° C., 20 hours | 1427.7 | 22.4 | 11093.2 | 21.7 | 10.3 | 6.2 | 47 |
| | | | 770° C., 20 hours | 467.5 | 27.3 | 8072.4 | 19.7 | 11.2 | 7.1 | 37 |
| | 1100° C., 5 hours (Cooling: 100° C./hour) | 530° C., 20 hours | 630° C., 20 hours | 4769.4 | 18.6 | 14782.8 | 15.3 | 10.7 | 1.7 | 98 |
| | | | 680° C., 20 hours | 3890.8 | 21.7 | 20179.2 | 18.3 | 10.3 | 3.6 | 82 |
| | | | 710° C., 20 hours | 3763.9 | 22.4 | 22451.7 | 20.7 | 10 | 4.2 | 65 |
| | | | 770° C., 20 hours | 2011.2 | 27.5 | 14769.7 | 19.7 | 10.5 | 5.1 | 60 |
| | | 570° C., 20 hours | 630° C., 20 hours | 5129.3 | 16.7 | 15288.7 | 15.7 | 9.8 | 2.9 | 83 |
| | | | 680° C., 20 hours | 4098.5 | 20.7 | 20911.7 | 18.3 | 9.4 | 5.1 | 61 |
| | | | 710° C., 20 hours | 3728.6 | 21.7 | 21769.4 | 21.3 | 9.7 | 6.2 | 47 |

TABLE 3-continued

| Quenching treatment | First stage tempering treatment | Second stage tempering treatment | Creep rupture characteristics: 625° C., 20 kgf/mm² Creep rupture life, hour | Creep rupture characteristics: 625° C., 20 kgf/mm² Creep rupture elongation, % | Creep rupture characteristics: 625° C., 15 kgf/mm² Creep rupture life, hour | Creep rupture characteristics: 625° C., 15 kgf/mm² Creep rupture elongation, % | Resistance to steam oxidation 625° C., 3000 hours, mg/cm² | Toughness: Charpy impact value at room temperature, kgf-m/cm² | Toughness: Fracture appearance transition temperature (FATT), ° C. |
|---|---|---|---|---|---|---|---|---|---|
| | | 770° C., 20 hours | 1859.2 | 26.6 | 14382.6 | 20.7 | 10 | 6.8 | 36 |
| | 610° C., 20 hours | 630° C., 20 hours | 3122.4 | 17.3 | 15432.1 | 16.3 | 11.5 | 2.6 | 82 |
| | | 680° C., 20 hours | 1894.2 | 21.7 | 13037.2 | 17.7 | 10.2 | 5.3 | 62 |
| | | 710° C., 20 hours | 1429 | 22.5 | 12117.2 | 21.3 | 9.9 | 6.1 | 48 |
| | | 770° C., 20 hours | 469.5 | 25.7 | 7683.1 | 20.3 | 9.9 | 6.7 | 36 |
| 1150° C., 5 hours (Cooling: 100° C./hour) | 530° C., 20 hours | 630° C., 20 hours | 5653.8 | 15.7 | 16736.8 | 12.3 | 10 | 1.3 | 125 |
| | | 680° C., 20 hours | 4356.3 | 17.3 | 22056.4 | 14.3 | 10.4 | 2.3 | 95 |
| | | 710° C., 20 hours | 4213.8 | 20.3 | 23056.7 | 16.7 | 9.9 | 3.9 | 85 |
| | | 770° C., 20 hours | 2278.5 | 21.7 | 17678.5 | 16 | 9.9 | 2.4 | 72 |
| | 570° C., 20 hours | 630° C., 20 hours | 5324.9 | 15.7 | 15942.1 | 16.3 | 11.3 | 1.6 | 98 |
| | | 680° C., 20 hours | 4352.6 | 18.7 | 23045.8 | 16.7 | 9.9 | 3.6 | 75 |
| | | 710° C., 20 hours | 4126.5 | 19.3 | 21737.9 | 17 | 10.8 | 4.4 | 62 |
| | | 770° C., 20 hours | 2507.6 | 20.7 | 17056.8 | 14.7 | 10.2 | 5.1 | 50 |
| | 610° C., 20 hours | 630° C., 20 hours | 3428.8 | 14.7 | 17236.3 | 12.3 | 11.1 | 1.6 | 96 |
| | | 680° C., 20 hours | 2483.5 | 19.4 | 15068.2 | 14.3 | 11.5 | 3.7 | 78 |
| | | 710° C., 20 hours | 1678.3 | 18.5 | 13659.3 | 13.7 | 10.8 | 4.3 | 74 |
| | | 770° C., 20 hours | 654.5 | 17.3 | 8767.5 | 13.3 | 10.9 | 5.2 | 55 |

It is seen as shown in Table 3 that test samples thermally treated at the quenching temperatures of 1070° C. and 1100° C., the first stage tempering temperature of 570° C., and the second stage tempering temperatures of 680° C. and 710° C. are excellent in all of high-temperature creep rupture characteristics, toughness and resistance to steam oxidation.

Thus, it is seen that the creep rupture characteristics and toughness are influenced depending on the heat treatment conditions of quenching treatment and tempering treatment. And, it is seen that excellent forging heat resistant steel can be obtained in view of the creep rupture characteristics, toughness and resistance to steam oxidation by applying appropriate heat treatment conditions.

(Evaluation of a Quantity of Fine Nb(C, N) Carbonitride)

The above-described test sample 1 to test sample 69 were used to examine a quantity of Nb(C, N) carbonitride with a diameter of 50 nm or less before and after an aging treatment at a temperature of 625° C. for ten thousand hours.

Test pieces were produced from individual steel ingots before and after the aging treatment, and their surfaces were mirror-finished and subjected to etching treatment with an etching solution. The precipitate on the etched surface was observed through a transmission electron microscope (TEM) according to an extraction replica method, and the size and quantity of Nb(C, N) carbonitride were quantified by an image analysis method.

On a predetermined observation area, a ratio (numeral after aging treatment/numeral before aging treatment) of a quantity of Nb(C, N) carbonitride with a diameter of 50 nm or less after the aging treatment to a quantity of Nb(C, N) carbonitride with a diameter of 50 nm or less before the aging treatment was calculated as a survival rate after the aging treatment. Table 2 shows the survival rates after the aging treatment of the quantity of Nb(C, N) carbonitride with a diameter of 50 nm or less.

It is seen as shown in Table 2 that all test sample 1 to test sample 53 have a survival rate of 50% or more after the aging treatment.

As described above, the forging heat resistant steel of the embodiment has a long creep rupture life and also has excellent creep rupture strength and toughness. It also has excellent resistance to steam oxidation.

According to the above-described embodiment, it becomes possible to have an excellent prolonged creep rupture life, creep rupture strength, toughness, and resistance to steam oxidation.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A forging heat resistant steel, containing in percent by mass C: 0.05-0.2, Si: 0.01-0.1, Mn: 0.01-0.15, Ni: 0.05-1, Cr: 8 or more and less than 9, Mo: more than 0.5 and 1 or less, V: 0.05-0.3, Co: 1-5, W: 1-2.2, N: 0.01 or more and less than 0.015, Nb: 0.01-0.15, B: 0.003-0.03, and a remainder comprising Fe and unavoidable impurities L, wherein a quantity of Nb(C,N) carbonitride having a diameter of 50 nm or less after aging treatment at a temperature of 625° C. for 10000 hours is 50% or more of that before the aging treatment.

2. A forged part having at least prescribed portions made of the forging heat resistant steel according to claim 1.

3. A manufacturing method of the forging heat resistant steel according to claim 1, comprising melting raw materials required to obtain component elements of the forging heat resistant steel, pouring into a prescribed mold to form a steel ingot, carrying out a forging process, carrying out a quenching treatment at a temperature of 1040 to 1120° C., carrying out a first stage tempering treatment at a temperature of 540 to 600° C., and carrying out a second stage tempering treatment at a temperature of 650 to 750° C.

4. A manufacturing method of the forging heat resistant steel according to claim 3, wherein a cooling rate after heating by the quenching treatment is 50 to 300° C./hour in the center part of the forging heat resistant steel, a cooling rate after heating by the first stage tempering treatment is 20 to 100° C./hour in the center part of the forging heat resistant steel, and a cooling rate after heating by the second stage tempering treatment is 20 to 60° C./hour.

5. A manufacturing method of the forged part according to claim 2, comprising melting raw materials required to obtain component elements of the forging heat resistant steel to make the forged part, pouring into a prescribed mold to form a steel ingot, carrying out a forging process, carrying out a quenching treatment at a temperature of 1040 to 1120° C., carrying out a first stage tempering treatment at a temperature of 540 to 600° C., and carrying out a second stage tempering treatment at a temperature of 650 to 750° C.

6. The manufacturing method of the forged part according to claim 5, wherein a cooling rate after heating by the quenching treatment is 50 to 300° C./hour in the center part of the forged part, a cooling rate after heating by the first stage tempering treatment is 20 to 100° C./hour in the center part of the forged part, and a cooling rate after heating by the second stage tempering treatment is 20 to 60° C./hour.

7. The forging heat resistance steel according to claim 1, comprising Cr in an amount of 8-8.5% by mass.

8. The forging heat resistance steel according to claim 1, comprising Cr in an amount of 8.5 to less than 9% by mass.

9. The forging heat resistance steel according to claim 1, comprising Cr in an amount of 8 to 8.9% by mass.

10. The forging heat resistance steel according to claim 1, comprising Cr in an amount of 8 to 8.8% by mass.

11. The forging heat resistance steel according to claim 1, comprising Cr in an amount of 8 to 8.7% by mass.

12. The forging heat resistance steel according to claim 1, comprising Cr in an amount of 8 to 8.6% by mass.

* * * * *